US006097366A

United States Patent [19]

Kerigan et al.

[11] Patent Number: 6,097,366

[45] Date of Patent: Aug. 1, 2000

[54] ANALOG DISPLAY INTERFACE STORING COLOR VALUES BASED UPON USER CONTROLLED CALIBRATION

[75] Inventors: Shaun Kerigan, Kilmacolm; Richard Ian Knox, Bridge of Weir; Christopher Carlo Pietrzak, Gourock, all of United Kingdom

[73] Assignee: International Business Machines Corporation, Armonk, N.Y.

[21] Appl. No.: 08/838,224

[22] Filed: Apr. 3, 1997

[30] Foreign Application Priority Data

Sep. 14, 1996 [GB] United Kingdom ..... 9619265

[51] Int. Cl.[7] ..... G09G 5/02

[52] U.S. Cl. ..... 345/150; 345/153; 345/199; 345/186

[58] Field of Search ..... 345/150, 307, 345/87, 89, 153, 152, 154, 186, 199; 358/517, 518, 519

[56] References Cited

U.S. PATENT DOCUMENTS 4,713,779 12/1987 Graciotti et al. ..... 364/521
5,311,212 5/1994 Beretta ..... 345/150
5,673,065 9/1997 Deleeuw ..... 345/153

FOREIGN PATENT DOCUMENTS 0340664 11/1989 European Pat. Off. .
0358918 3/1990 European Pat. Off. .
0385449 9/1990 European Pat. Off. .
0443581 8/1991 European Pat. Off. .
0445562 9/1991 European Pat. Off. .
2140660 11/1984 United Kingdom .

*Primary Examiner*—Amare Mengistu
*Assistant Examiner*—Francis N. Nguyen
*Attorney, Agent, or Firm*—Jay P. Sbrollini

[57] ABSTRACT

An analogue display interface apparatus for providing analog color signals to a digital display unit includes a table look-up mechanism that provides digital representations of color signals to a color palette, wherein some of the values stored in the lookup table are received from the output of a calibration mechanism that displays a plurality of color choices on the digital display unit for selection by a user.

6 Claims, 3 Drawing Sheets

FIG. 3

22

R

| INPUT (221) | OUTPUT (222) |
|---|---|
| 0 | 0 |
| 1 | 0 |
| 2 | 0 |
| 3 | 0 |
| 4 | 6 |
| 5 | 6 |
| 6 | 6 |
| 7 | 6 |
| 8 | 9 |
| 9 | 9 |
| 10 | 9 |
| 11 | 9 |
| 12 | 14 |
| 13 | 14 |
| 14 | 14 |
| 15 | 14 |
| 16 | 17 |
| 17 | 17 |
| 18 | 17 |
| 19 | 17 |
| 20 | 22 |
| 21 | 22 |
| 22 | 22 |
| 23 | 22 |
| 24 | 26 |
| 25 | 26 |
| 26 | 26 |
| 27 | 26 |
| . | . |
| . | . |
| . | . |
| 60 | 63 |
| 61 | 63 |
| 62 | 63 |
| 63 | 63 |

223

224

ANALOG DISPLAY INTERFACE STORING COLOR VALUES BASED UPON USER CONTROLLED CALIBRATION

FIELD OF THE INVENTION

The present invention relates to a digital display, such as a liquid crystal display (LCD) panel, for displaying information output from a data processing device (such as a computer). More specifically, the invention relates to an analog interface for driving the digital display.

BACKGROUND OF THE INVENTION

Display units for displaying outputs from data processing devices have traditionally been analog in nature. The most typical example is a Cathode Ray Tube (CRT) display used in the common personal computer (PC). In such analog displays, analog interfaces in the PC's video driving unit provide three analog signals (red, green and blue) to the analog display. Each analog signal can assume, in this example, 1 out of 64 possible analog levels. Thus, the analog display is capable of displaying 262,144 different colors (64×64×64).

As shown in FIG. 1, the conventional analog interface includes a video memory 1 storing a digital label for uniquely indicating each of 256 possible colors which can simultaneously be used for display. The digital label contains 8-bits so that it can uniquely designate 256 different colors. The 8-bit digital label is output from video memory 1 onto line 4 to color palette chip 2. For each of the 256 digital labels, color palette chip 2 stores a set of three digital values, one for each of the primary display colors red (R), green (G) and blue (B) that make up the corresponding color. Each of the three digital values is a 6-bit digital word thus allowing for 64 different levels. The three 6-bit words are output from the color palette chip 2 via a built-in digital-to-analog (D/A) converter and sent as three 64-level analog signals 5, 6 and 7 to analog display 3 (such as a CRT).

In operation, the PC is running an application program which requires that a certain color be displayed. The application program tells the PC's video display device driver (in the ROM BIOS) to display that certain color. Video memory 1 then outputs the 8-bit digital word on line 4 indicating that color. Color palette chip 2 receives the 8-bit word and outputs three analog 64-level signals 5 (for R), 6 (for G) and 7 (for B) to the analog display 3.

There are only 256 colors stored in the palette chip, yet there is a total of 262,144 colors available. The user can custom-design the palette chip 2 to store different colors therein. Alternatively, the application program itself can write directly to the palette chip 2 to change its colors if the application program requires a certain set of colors to be used.

Digital displays have recently been growing in popularity, especially for portable uses such as in notebook computers. The most typical example of a digital display is an LCD panel. Digital displays typically require that the R, G and B driving signals represent a smaller number of total levels than in an analog display. For example, in a digital display each of the R, G and B driving signals represent one of only 16 different levels (as opposed to one of 64 in the analog display). A 4-bit digital word (allowing 16 levels) is thus used in a digital display, while a 6-bit digital word (allowing for 64 levels) is used in the digital portion of the interface circuitry for driving the analog display. The digital display of our example is thus capable of displaying only 4,096 colors (16×16×16) as opposed to the 262,144 colors (64×64×64) displayable by the analog display.

Despite these differences, it is highly advantageous to drive a digital display using existing standard analog driver interfaces, such as the one shown in FIG. 1. This eliminates the need to provide a dedicated digital driving interface, and efficient use can be made of pre-existing circuitry without hardware modification.

However, to do so requires that the analog interface's 6-bit primary color signals be reduced to 4-bit signals so as to be compatible with the digital display.

One common way of making this reduction is simply to ignore the 2 least significant bits during the analog-to-digital (A/D) conversion that occurs inside the digital display. This, however, can produce undesirable effects since the analog signal will contain some noise and the effect of this noise will be greatly amplified by ignoring these 2 bits. Although the noise is only equivalent to a transition in the least significant bit it may actually have an effect on the fourth highest bit. That is, if the analog interface drives the 6-bit digital word 010011, the display should see this as 0100 (i.e. the least significant 2 bits are ignored). If noise equivalent to 000001 is present it will increase the value of the 6-bit digital word to 010100 and the digital display will see 0101 (instead of the desired 0100). Thus, a small amount of noise is greatly amplified and results in a different color being displayed and the error is clearly visible to the user.

There is thus a need for an improvement to the analog interface driving a digital display so that less noise (in the guise of the wrong color being displayed) is perceptible to the user.

SUMMARY OF THE INVENTION

In accordance with the present invention, there is now provided an analog interface apparatus for driving a digital display unit, said apparatus comprising: a color palette means for storing color signals for driving said digital display unit; and a look up table means for storing color signals for driving said digital display unit and for supplying said color signals to said color palette means, said look up table including means for interrupting write operations to said color palette means by receiving as inputs color signals of said write operations and providing as outputs color signals having a resolution matching that of said digital display unit.

Preferably, for each primary color, said look up table stores one output value for a plurality of adjacent input values when said input values are arranged in ascending order in said table, and said one output value is selected to be the input value of said plurality of adjacent input values which provides the least noise with respect to the other input values of said plurality of input values.

In a preferred embodiment, the apparatus further comprises a calibration means for setting said one output value in said look up table by displaying colors on said digital display unit corresponding to each of said plurality of adjacent input values so that a user can select one of said colors using an input means.

Preferably, said means for interrupting is implemented in software as an addition to the operating system as a Terminate and Stay Resident program.

Viewing the present invention from a second aspect, there is provided a computer program stored on a storage medium readable by a computer, said program comprising: means for recognizing a write operation to a color palette unit of an analog display interface; means for intercepting said write operation, taking color information contained in said write operation and substituting therefor other color information having a resolution matching that of a digital display unit driven by said analog display interface.

Preferably, said program is an addition to the operating system of said computer as a Terminate and Stay Resident program, and the program further comprising calibration means for setting values of said other color information using a feedback routine.

Viewing the present invention from a third aspect, there is now provided a method of selecting color information for a color palette unit of an analog display interface for driving a digital display unit, comprising steps of: detecting a write operation to said color palette unit: intercepting said write operation, taking color information contained in said write operation and substituting therefor other color information having a resolution matching that of said digital display unit driven by said analog display interface; and writing said other color information into said color palette unit for use in driving said digital display unit.

Viewing the present invention from a fourth aspect, there is now provided a computer system having the analog interface apparatus mentioned above, said computer system also having a processor, bus and memory means.

The analog interface apparatus, computer program and method of the present invention allows an existing analog interface apparatus hardware assembly to be used to drive a digital display unit without suffering from noise problems (causing the wrong color to be displayed) existing in the prior art.

BRIEF DESCRIPTION OF THE DRAWINGS

FIG. 3 shows a partial example of the contents of the look up table in the embodiment of FIG. 2.

DETAILED DESCRIPTION OF THE PREFERRED EMBODIMENTS

Figure 1:
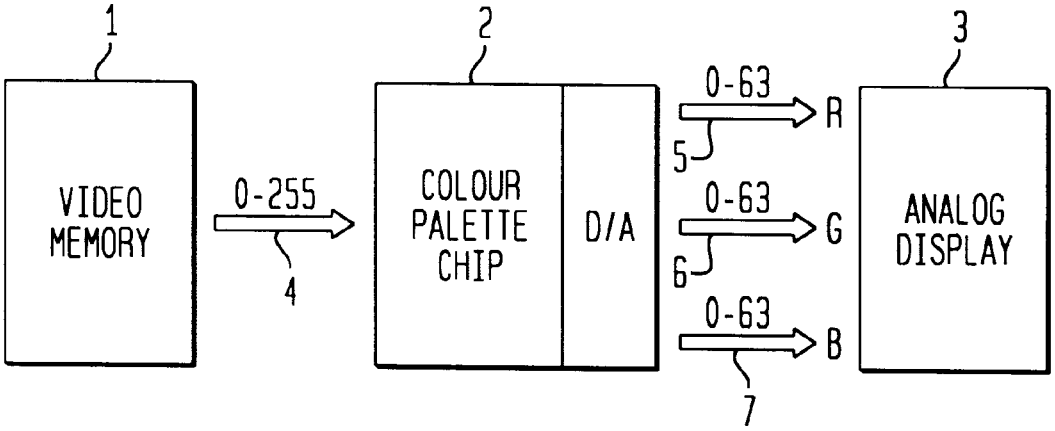
FIG. 1 (PRIOR ART)
FIG. 1 shows a conventional analog interface driving an analog display.
Figure 2:
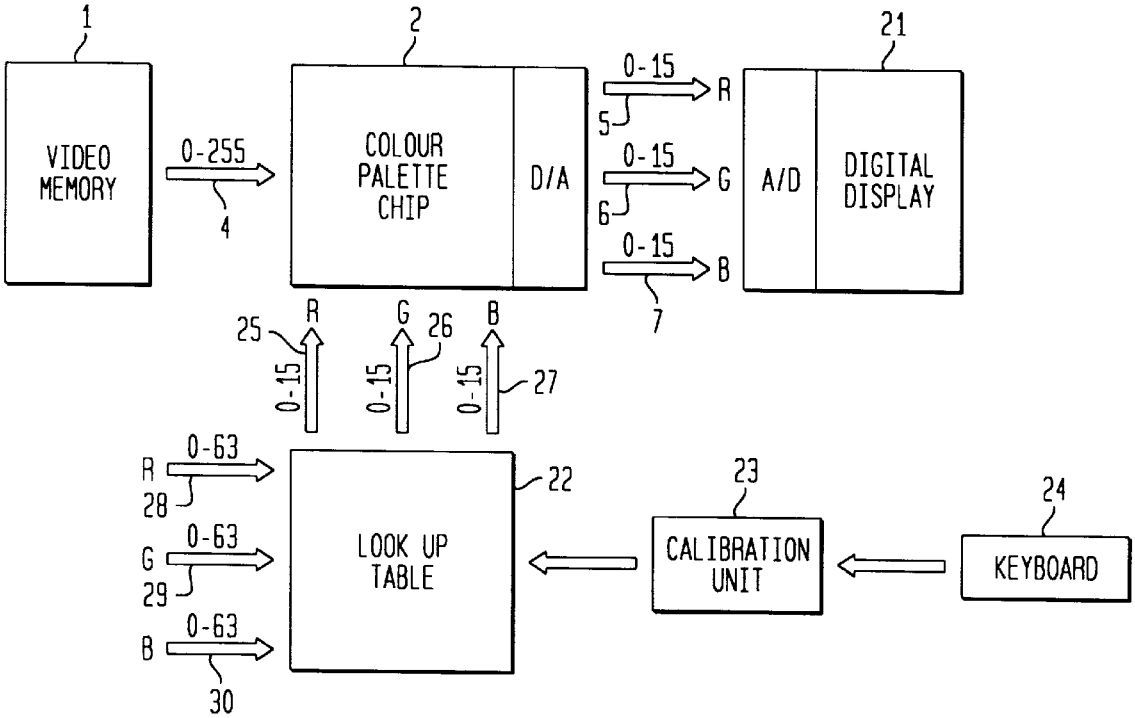
FIG. 2 (PRIOR ART)
FIG. 2 shows an embodiment of the present invention, to allow the analog interface to drive a digital display.

In FIG. 2 the video memory 1 and color palette chip 2 are of the same construction as described in FIG. 1 and will not be described in detail herebelow.

A major difference between FIG. 1 and FIG. 2 is the possible values assumable by the R, G, B signals on lines 5, 6 and 7, respectively output from the color palette chip's D/A converter. In FIG. 1 the signals can assume 64 analog levels, capable of representing 262,144 colors. In FIG. 2 the signals can assume only 16 analog levels, capable of representing only 4,096 colors. Thus, when an 8-bit digital word is supplied from video memory 1, color palette chip 2 outputs three analog signals (R, G and B) on lines 5–7, each signal having one out of only 16 possible levels. These three 16-level signals are then directly and completely converted to 4-bit digital words compatible with the digital display 21, by using the digital display's internal A/D converter. The words "directly and completely" used above mean that no bits are ignored (as in the conventional technique described above) after A/D conversion.

The video memory 1, color palette chip 2 and digital display 21 are used during normal operation of the data processing system wherein the analog interface is commanded to display certain colors on the display. The further discussion presented immediately below explains how the 16 possible levels on lines 5–7 are chosen (out of the 64 total available levels which could be output from palette chip 2 on each of lines 5–7).

FIG. 2 includes a look up table 22 (which can be written in available RAM or on the hard disk) which stores, for each primary color (R, G, B) a 6-bit word representing a selected value (out of a group of 16 values) corresponding to a 6-bit word representing one of a group of 64 values. That is, for R, the band of 64 possible values is divided into sixteen sub-bands of 4 values each, and one value is chosen from each sub-band. This chosen value is stored in look up table 22 in a location corresponding to each of the 4 members of the respective sub-band. Then, when a 6-bit value of R arrives on line 28 (this value can assume 64 different values) the stored corresponding 6-bit signal is output on line 25 to the color palette chip 2. This signal appearing on line 28, while a 6-bit signal, can only assume 16 values, because only 16 values are used when the data is stored in the look up table 22, as explained above. The same is done for the other two primary colors G and B.

FIG. 3 shows an example of the contents of look up table 22 for one of the three primary colors (R), a similar data structure exists for the other two primary colors G and B. The input column 221 lists each of the 64 values which the R signal appearing on line 28 may assume (it is a 6-bit signal). In FIG. 3 the digital values (0–63) are shown for clarity, however, the 6-bit binary equivalents would physically be stored in memory. An output column 222 is provided opposite the input column 221. The output column 222 stores the values which will be output on look up table output line 25 when the corresponding input column value is input to look up table input line 28. For example, when a 6-bit value representing "20" is input on line 28 the corresponding 6-bit value representing "22" is output from the table 22 onto line 25.

Thus, whenever a user tries to add a color to the color palette chip, the user's color selection (appearing on lines 28–30) is intercepted by the look up table 22 and converted to a different color and output onto lines 25–27 to the color palette chip for color writing therein. Also, when an application program (such as a computer graphics software package or desktop publishing software package) tries to write a particular color to the palette chip 2, the look up table 22 would similarly interrupt the write operation and substitute the stored color for the application program's intended color.

This ensures that only 16 different levels are used to form the three primary color components of the 256 colors existing in the color palette chip 2. Because only 16 levels are used, only 16 levels can be sent on lines 5–7 to the digital display 21. These 16 levels are then converted to four-bit digital signals by the digital display's A/D converter.

The choice of which one of the four input column values in each of the 16 bands to place in the output column is made using a calibration procedure using calibration unit 23 and keyboard 24 as follows with reference to FIG. 3. For the first band 223 (having four values 0–3) the lowest value "0" of the four values is chosen. For the 16th band 224 (the highest band containing the values 60–63) the highest value "63" of the four values is chosen. For each of the other 14 bands in between these two bands, the calibration unit causes colors corresponding to each of the four potential values to be displayed on the display 21 and the user selects, via keyboard 24, the one of the four colors which appears to have the least noise (i.e., the one that looks the best of the four, according to the user's perspective). The value corresponding to this selected color is then written to the look up table 22. This process is repeated for each of the remaining bands for one primary color. Then, the overall process is repeated for the other two primary colors. This fills up the look up table 22.

While the described interception of a color palette write operation could be implemented with the addition of additional hardware, the preferred embodiment is a software approach involving a user-loadable addition to the operating system. In the DOS operating system, this can be done by writing a DOS Terminate and Stay Resident (TSR) program which intercepts write operations to the color palette using the standard BIOS INT 10H interface. The selected values for storing in the look up table are configurable by the user through a calibration program operating as described above with respect to the function of calibration unit 23.

When an application program needs to display data, the device driver in the ROM BIOS (firmware) is used. The TSR program added to the computer's operating system software controls the data which is supplied to the device driver by performing a data substitution using the look up table 22. The RSR program can also be implemented as an addition to the BIOS itself.

Since some program applications bypass the BIOS and write directly to the palette chip, the TSR can be further programmed to use the system unit's timer interrupt to periodically (e.g. 13 times per second) check the values stored in palette chip 2 and replace any values which are not of the selected 16 values with its corresponding value as stored in the look up table 22. In the "Windows" (a Microsoft trademark) and "OS/2" (an IBM trademark) operating systems, all accesses to the palette chip are through the BIOS so there is no need for the timer interrupt routine.

Because the invention can be implemented in software, there is no need to change the standard hardware of the PC's analog interface, thus making the invention compatible with existing hardware. Further, because the software can be implemented as a user-loadable addition to the operating system, it is completely independent of the application program. Therefore, there should be no compatibility problems because there is no need to modify the application code. As is well known, a computer's operating system is stored on a computer readable storage medium such as a hard drive or semiconductor memory (e.g., DRAM). Accordingly, the addition to the operating system according to the present invention would also be so-stored.

The invention can also be applied to situations when a digital display and an analog display are used at the same time. The color information on the analog display is made to match that of the digital display using the look up table, thus making the two displays display the same colors. Note that in the conventional technique where 2-bits are ignored, this would not necessarily be the case, as is clear from the above discussion of the conventional technique.

The above description of a preferred embodiment of the present invention refers to a 4096 color digital display and a standard PC (VGA) purely as an example. The invention is applicable to any video sub-system and any digital display where the digital display is unable to display the full range of colors provided by the video sub-system.

We claim:

1. An analog display interface apparatus adapted for driving a digital display unit by providing analog color signals to the digital display unit, such analog signals being converted to digital form upon receipt by the digital display unit, said interface apparatus comprising:

a video memory means for storing a plurality of digital labels each for identifying a color which can be used for display and for outputting a digital label representing a color which has been selected for display;

color palette mapping means for receiving the digital label from the video memory means and mapping the digital label to a digital representation of a color signal to be used for display; and means for converting into analog form the digital representation of the color signal to be used for display and providing the converted color signal in analog form to the digital display unit;

wherein the analog interface apparatus also includes an updating means for updating the digital representations of color signals which are held in the color palette mapping means, the updating means including a look up table mapping means for receiving write commands containing new digital representations of color signals for updating the color palette mapping means and outputting corresponding digital representations of color signals to the color palette mapping means to update the digital representations of color signals which are held in the color palette mapping means; and wherein some of the values stored in the lookup table mapping means are received from the output of a calibration means which displays a plurality of color choices on the digital display unit so that a user can select one of the color choices for storing in the lookup table mapping means.

2. The apparatus of claim 1 wherein, for each primary color, said look up table mapping means stores one output value for a plurality of adjacent input values when said input values are arranged in sequential order in a table.

3. The apparatus of claim 1 wherein said updating means is implemented in software as an addition to the operating system.

4. The apparatus of claim 1 wherein said updating means is implemented in software as an addition to the system firmware.

5. The apparatus of claim 1 wherein said updating means is implemented in software as a Terminate and Stay Resident program.

6. The apparatus of claim 1 wherein the lookup table mapping means has an input column sequentially listing the n possible colors which might be used by a write command to update the color palette mapping means and an output column listing a corresponding color for each of the n colors in the input column, wherein the n colors in the input column are broken up into k sequential sub-bands of m colors each, and for each of the k sub-bands one of the m colors is selected for inclusion in the output column as the corresponding color for each of the m colors in the sub-band, with the selected color being selected by user selection via the calibration means.

* * * * *